US010630034B2

(12) United States Patent
Wankoff et al.

(10) Patent No.: US 10,630,034 B2
(45) Date of Patent: Apr. 21, 2020

(54) INTEGRATED ANTENNA UNIT WITH BLIND MATE INTERCONNECT

(71) Applicant: Amphenol Corporation, Wallingford, CT (US)

(72) Inventors: Eric Wankoff, Stamford, CT (US); Ken Capozzi, Navgatuck, CT (US); Michael A. Hoyack, Sandy Hook, CT (US); Owen R. Barthelmes, Putnam Valley, NY (US)

(73) Assignee: Amphenol Corporation, Wallingford, CT (US)

( * ) Notice: Subject to any disclaimer, the term of this patent is extended or adjusted under 35 U.S.C. 154(b) by 1011 days.

(21) Appl. No.: 14/870,414

(22) Filed: Sep. 30, 2015

(65) Prior Publication Data

US 2016/0352042 A1 Dec. 1, 2016

Related U.S. Application Data

(60) Provisional application No. 62/166,931, filed on May 27, 2015.

(51) Int. Cl.

| | |
|---|---|
| ***H01Q 1/12*** | (2006.01) |
| ***H01R 24/52*** | (2011.01) |
| ***H01Q 3/06*** | (2006.01) |
| ***H01R 13/631*** | (2006.01) |
| ***H01Q 1/24*** | (2006.01) |

(Continued)

(52) U.S. Cl.

CPC ..... *H01R 24/52* (2013.01); *H01Q 1/125* (2013.01); *H01Q 1/1228* (2013.01); *H01Q 1/246* (2013.01); *H01Q 3/06* (2013.01); *H01R 13/6315* (2013.01); *H01R 13/2421* (2013.01); *H01R 13/5219* (2013.01); *H01R 2103/00* (2013.01); *H01R 2201/02* (2013.01)

(58) Field of Classification Search

CPC ..... H01Q 1/12; H01Q 1/2228; H01Q 1/125; H01Q 1/246; H01Q 1/50; H01R 13/6315; H01R 24/52; H01R 2201/02; H01R 13/00

USPC ..... 439/578

See application file for complete search history.

(56) References Cited

U.S. PATENT DOCUMENTS

| | | | |
|---|---|---|---|
| 3,196,382 | A | 7/1965 | Morell, Jr. |
| 4,030,797 | A | 6/1977 | Nieman |

(Continued)

FOREIGN PATENT DOCUMENTS

| | | |
|---|---|---|
| CN | 1353817 A | 6/2002 |
| EP | 2304651 B1 | 4/2011 |

OTHER PUBLICATIONS

International Search Report for PCT/US2015/053573 dated Dec. 22, 2015, 3 pages.

(Continued)

*Primary Examiner* — Dameon E Levi
*Assistant Examiner* — Hasan Z Islam
(74) *Attorney, Agent, or Firm* — Blank Rome LLP

(57) ABSTRACT

An antenna unit that includes an antenna, at least one radio unit, and an interconnect that includes first and second mating connectors. The first connector is configured to be electrically and mechanically coupled to the antenna and the second connector is configured to be electrically and mechanically coupled to the at least one radio unit. The first connector has lead-in geometry, and radial and axial float for blind mating of the first and second mating connectors.

14 Claims, 7 Drawing Sheets

(51) Int. Cl.

| | |
|---|---|
| *H01R 103/00* | (2006.01) |
| *H01R 13/52* | (2006.01) |
| *H01R 13/24* | (2006.01) |

(56) References Cited

U.S. PATENT DOCUMENTS

| | | | | |
|---|---|---|---|---|
| 4,227,765 | A | 10/1980 | Neumann et al. | |
| 4,580,862 | A | 4/1986 | Johnson | |
| 4,789,351 | A | 12/1988 | Fisher, Jr. et al. | |
| 4,792,312 | A | 12/1988 | Yasumoto | |
| 4,815,986 | A | 3/1989 | Dholoo | |
| 4,891,743 | A | 1/1990 | May et al. | |
| 5,285,511 | A | 2/1994 | Akkapeddi et al. | |
| 5,329,262 | A | 7/1994 | Fisher, Jr. | |
| 5,352,134 | A | 10/1994 | Jacobsen et al. | |
| 5,516,303 | A * | 5/1996 | Yohn | H01R 13/6315 439/248 |
| 5,832,237 | A | 11/1998 | Lee | |
| 6,344,736 | B1 | 2/2002 | Kerrigan et al. | |
| 6,361,348 | B1 | 3/2002 | Hall et al. | |
| 7,329,139 | B2 | 2/2008 | Benham | |
| 7,553,185 | B1 | 6/2009 | Qu et al. | |
| 7,704,077 | B1 | 4/2010 | Morley | |
| 8,043,118 | B1 | 10/2011 | Lee | |
| 8,100,715 | B2 | 1/2012 | Whitlock et al. | |
| 8,149,224 | B1 | 4/2012 | Kuo et al. | |
| 8,172,617 | B2 | 5/2012 | Peng | |
| 8,358,121 | B2 | 1/2013 | Hudson et al. | |
| 8,386,374 | B2 | 3/2013 | Grek et al. | |
| 8,494,878 | B2 | 7/2013 | Stevens | |
| 8,917,235 | B2 | 12/2014 | Orsley et al. | |
| 2005/0048848 | A1 | 3/2005 | Axenbock et al. | |
| 2008/0139028 | A1 | 6/2008 | Burris et al. | |
| 2010/0189126 | A1 | 7/2010 | Lurie et al. | |
| 2010/0297867 | A1 | 11/2010 | Rosenberger | |
| 2011/0279337 | A1 | 11/2011 | Corwin et al. | |
| 2012/0035426 | A1 | 2/2012 | Mielcarz et al. | |
| 2012/0293391 | A1 | 11/2012 | Simmons et al. | |
| 2013/0021118 | A1 | 1/2013 | Yeates | |
| 2013/0065415 | A1 | 3/2013 | Van Swearingen et al. | |
| 2014/0179244 | A1 | 6/2014 | Colapietro et al. | |
| 2014/0218255 | A1 | 8/2014 | Sanford et al. | |
| 2014/0315408 | A1 | 10/2014 | Colapietro et al. | |
| 2015/0126120 | A1 | 5/2015 | Chen | |
| 2015/0144758 | A1 * | 5/2015 | Kolokotronis | H01Q 1/1228 248/282.1 |
| 2015/0147978 | A1 | 5/2015 | Davis et al. | |
| 2016/0104969 | A1 * | 4/2016 | An | H01R 24/40 439/248 |

OTHER PUBLICATIONS

Written Opinion for PCT/US2015/053573 dated Dec. 22, 2015, 9 pages.

White, P , "New antenna techniques can breathe new life into macro networks", Jan. 22, 2012, http://www.rethinkresearch.biz/articles/new-antenna-teachniques-can-breathe-new-life-into-macro-networks/.

"MWC 2014 Preview: Commscope unveils plug and play standards interface at top of cell tower", Feb. 12, 2014, http//www.wireless-mag.com/News/28207/mwc-2014-preview-commscope-unveils-plug-and-play-standard-interface-at-top-of-cell-tower.aspx#.Vg0uKbQweDo.

Vincent, M., Commscope simplifies base station antenna. RRU interface for easier cell tower upgrades, Feb. 13, 2014, http://www.cablinginstall.com/articles/2014/02/commscope-andrew-siterise-interface.html.

"CommScope crafts a total package for FFTA, remote radio depolyments", Jul. 17, 2013, http://www.businesswire.com/news/home/2013071700504/em/CommScope-Craits-Total-Package-FFTA-Remote-Radio#.Vg0lXLQweDo.

"How to spot sprint antennas and RRUs (Samsung)". May 30, 2013, http://s4gru.com/index.php?/topic/3906-how-to=spot-sprint-antennas-and-rrus-samsung/.

IEC Proposal titled Radio-Frequency Connectors; 38 pages; Jul. 16, 2013.

International Search Report for PCT/US2015/052519 dated Jan. 14, 2016, 2 pages.

* cited by examiner

INTEGRATED ANTENNA UNIT WITH BLIND MATE INTERCONNECT

RELATED APPLICATIONS

This application claims priority to U.S. Provisional Application No. 62/166,931 entitled Integrated Antenna Unit With Blind Mate Interconnect, filed on May 27, 2015.

FIELD OF THE INVENTION

The present invention relates to an integrated antenna unit with a blind mate interconnect. The interconnect is an RF connection system with a high degree of mechanical flexibility to allow for mating of two electronic units, such as an antenna and associated remote radio units.

BACKGROUND OF THE INVENTION

Integrated antenna units (IAU) where the remote radio unit(s) (RRU) is mounted behind the antenna or inside the antenna are gaining popularity amongst mobile operators. Such an approach yields an aesthetically pleasing antenna with no external jumper cables to link the remote radio unit to the antenna ports, thereby not only reducing installation time but also improving the gain of the system. However, the remote radio unit is frequency band specific and as such, any change in frequency bands would require the mobile operator to add a new antenna to the tower or replace the existing antenna with a new antenna.

Therefore, a need exists for an integrated antenna that can be easily modified, such as by swapping out the remote radio units, and that reduces installation and service time.

SUMMARY OF THE INVENTION

Accordingly, the present invention provides an antenna unit that includes an antenna, at least one radio unit, and an interconnect that includes first and second mating connectors. The first connector is configured to be electrically and mechanically coupled to the antenna and the second connector is configured to be electrically and mechanically coupled to the at least one radio unit. The first connector has lead-in geometry, and radial and axial float for blind mating of the first and second mating connectors.

The present invention may further provide an antenna unit that includes an antenna, a plurality of radio units, and a plurality of interconnects that each includes mating plug and jack connectors. Each of the plug connectors is configured to be electrically and mechanically coupled to the antenna and each of the jack connectors is configured to be electrically and mechanically coupled to one of the plurality of radio units. Each of the plug connectors includes a housing supporting a contact, a shroud having lead-in geometry, and a mounting body for mounting the plug connector to the antenna. The lead-in geometry along with radial and axial float of the plug connector facilitate blind mating of the plug and jack connectors.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing figures.

DETAILED DESCRIPTION OF THE PREFERRED EMBODIMENTS

Referring to FIGS. 1A, 1B, 1C, 2-5, and 6A-6C, the present invention generally relates to an integrated antenna unit 100 that has an RF connection system or interconnect 110 that allows blind mating between an antenna 102 and associated radio units 104 in multiple directions. The antenna unit 100 may be used in wireless communication systems, and is preferably an ultra wideband integrated antenna unit (IAU) platform with field replaceable radio units, which are frequency band specific. This allows the IAU platform to be deployed on antenna sites anywhere in the world as the IAU platform covers all current frequency bands globally, with frequency band specific components like the remote radio units (RRU) and diplexers being field replaceable for the specific requirements of each region.

Figure 1A:
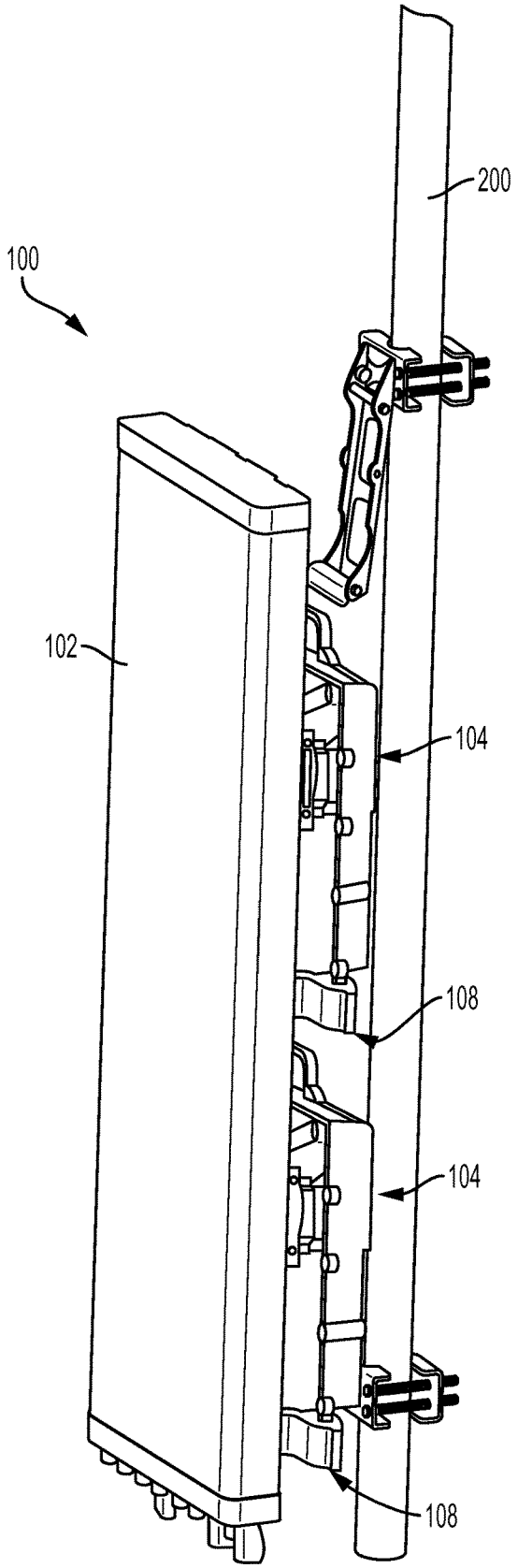
FIG. 1A is a front side perspective view of an integrated antenna unit with blind mate interconnect according to an exemplary embodiment of the present invention.
Figure 1B:
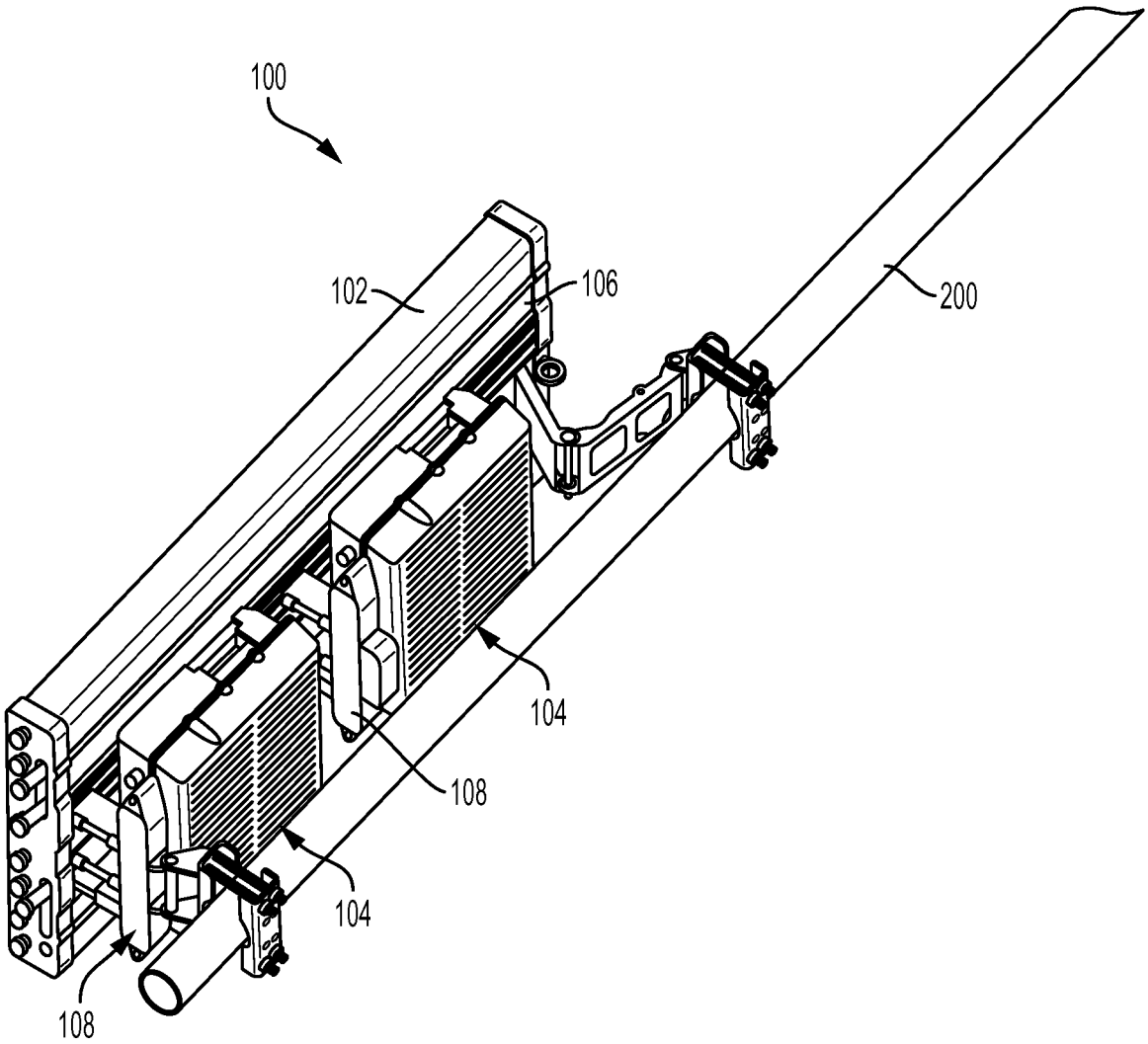
FIG. 1B is a rear perspective view of the integrated antenna unit with blind mate interconnect illustrated in FIG. 1A.
Figure 1C:
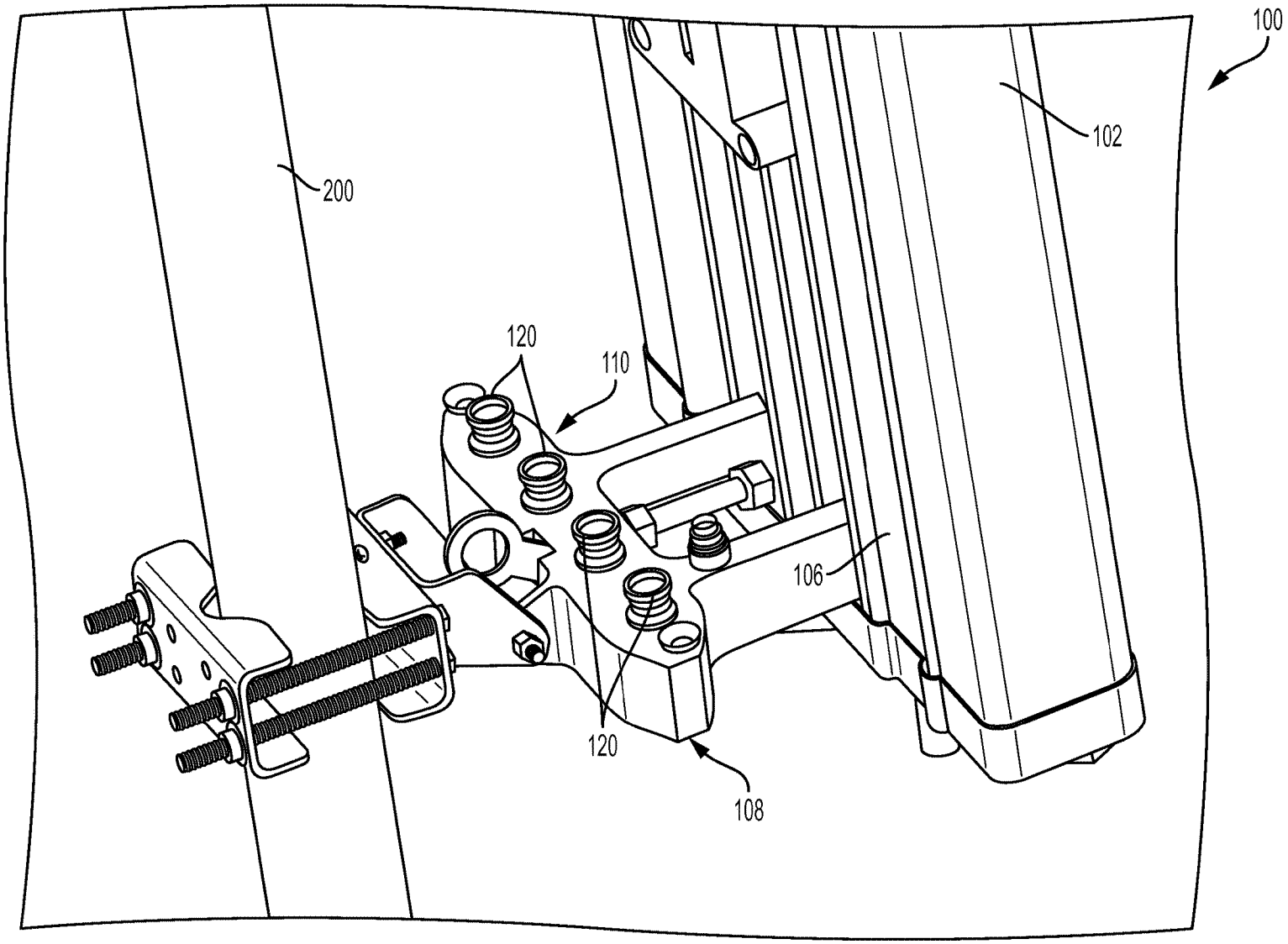
FIG. 1C is a partial enlarged bottom perspective view of the integrated antenna unit with bling mate interconnector illustrated in FIG. 1A.
Figure 2:
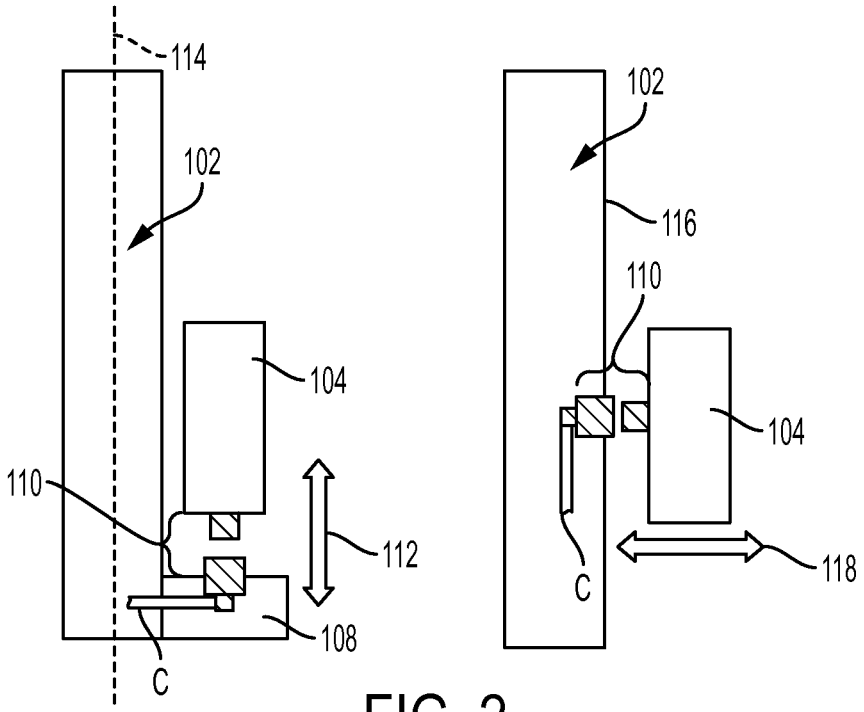
FIG. 2 is a schematic view of the integrated antenna unit with bling mate interconnect, showing the possible mating directions of the interconnect of the present invention.
Figure 3:
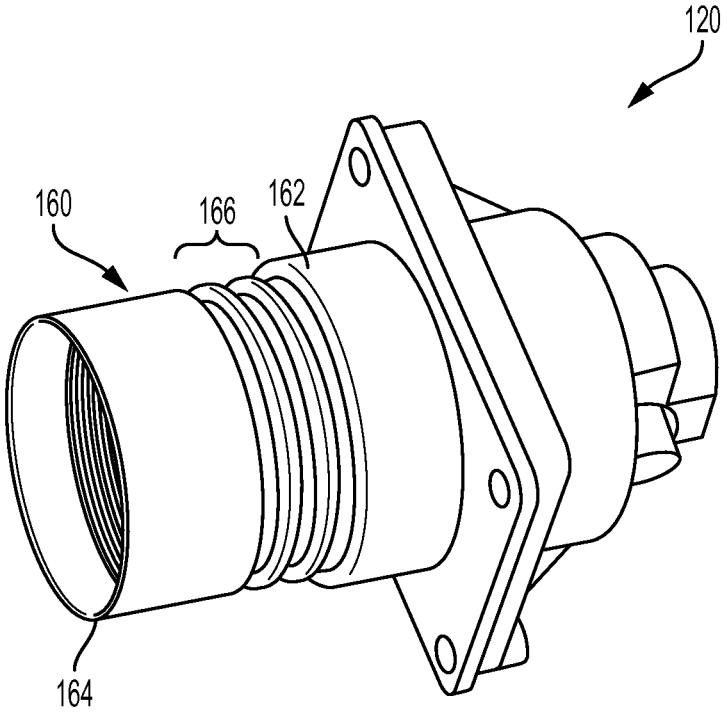
FIG. 3 is a perspective view of a connector of the interconnect of the present invention.
Figure 4:
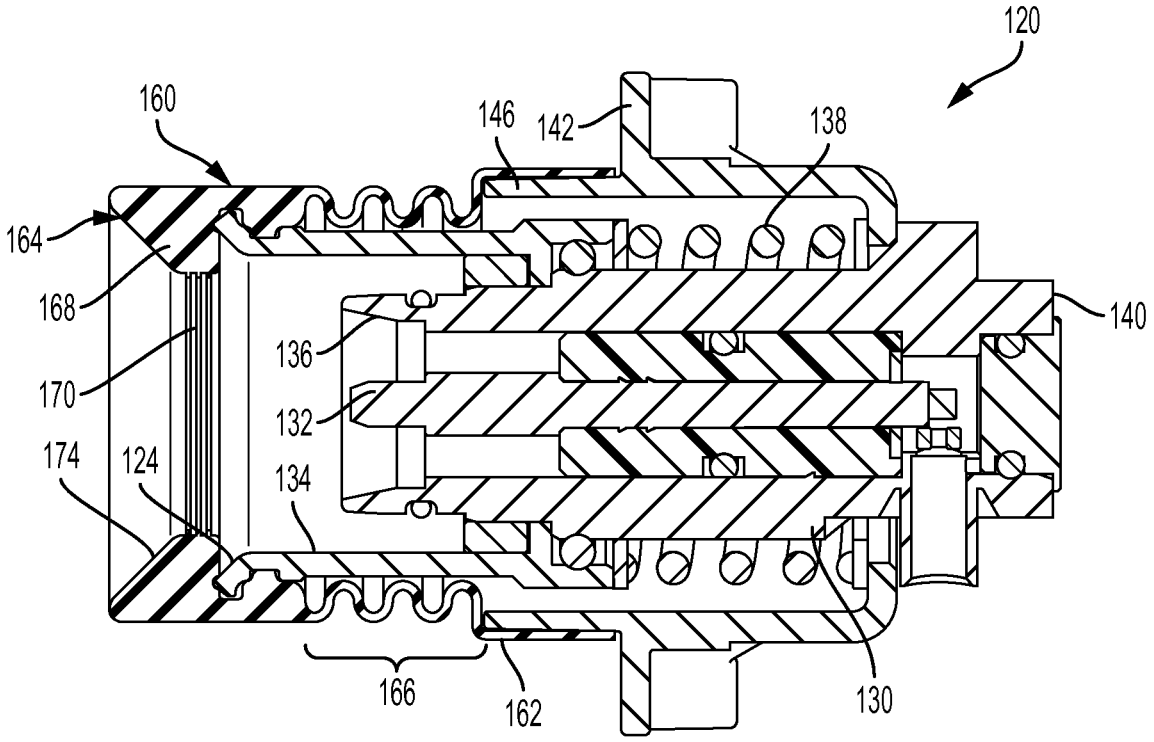
FIG. 4 is a cross-sectional view of the connector illustrated in FIG. 3.

As seen in FIGS. 1A, 1B, and 1C, the integrated antenna unit 100 includes the antenna 102 supported on a pole 200 with one or more of the remote radio units 104 mounted to a rear side 106 thereof. One or more docking stations 108 may extend from the rear side 106 of the antenna 102 for accepting the individual radio units 104. The docking stations 108 generally extend in a plane perpendicular to the plane of the antenna 102, as best seen in FIGS. 1C and 2. As such, the interconnect 110 allows the radio unit 104 to blind mate with the antenna in a first direction 112, which is generally parallel to the longitudinal axis 114 of the antenna 102. Alternatively, the docking station may be incorporated into the antenna housing 116 such that the interconnect 110 allows the radio unit to blind mate with the antenna 102 in a second direction 118, which is generally perpendicular to the first direction 112.

The interconnect 110 of the present invention provides an RF connection system with a high degree of mechanical flexibility to allow for blind mating of two electronic units, specifically the antenna 102 and the radio units 104. The connection provides robust RF performance and low Passive Intermodulation Distortion common in wireless mobile communication systems. The interconnect 110 may include first and second mating connectors 120 and 122 where the first mating connector 120 is configured to electrically and mechanically couple to the antenna 102, either in the docking station 108 or in the antenna housing 116 itself, and the second mating connector 122 is configured to electrically and mechanically couple to the radio unit 104. The first connector 120 may be a plug that preferably provides lead-in geometry 124 with both radial and axial float to facilitate blind mate connection with the second connector 122. The second connector 122 is a mating connector, such as a jack, preferably a 4.3-10 standard jack.

Figure 6A:
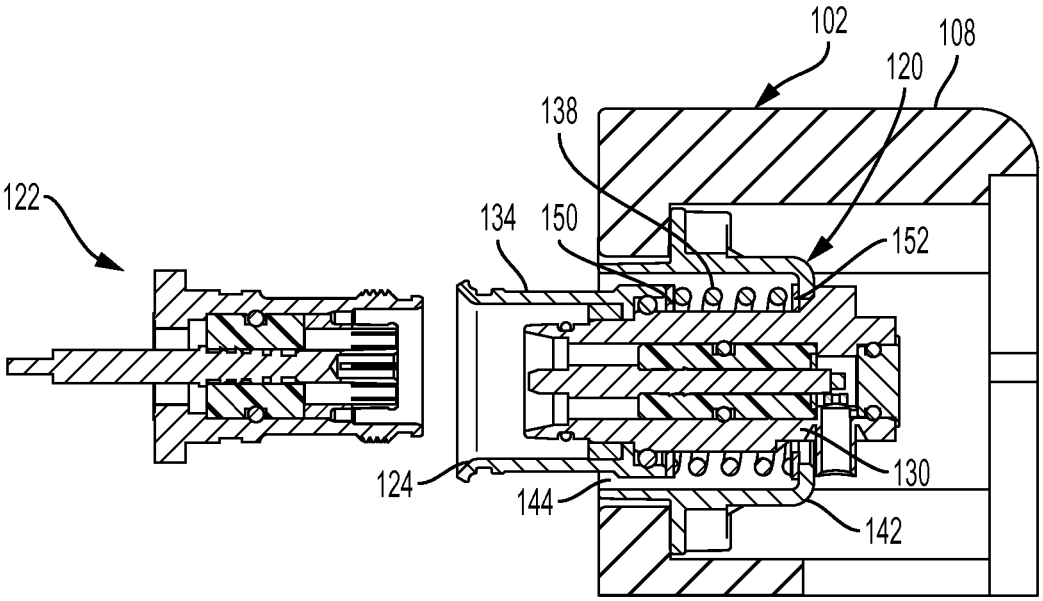
FIG. 6A is an exploded cross-sectional view of the interconnect of the present invention, showing the mating connectors exploded.
Figure 6B:
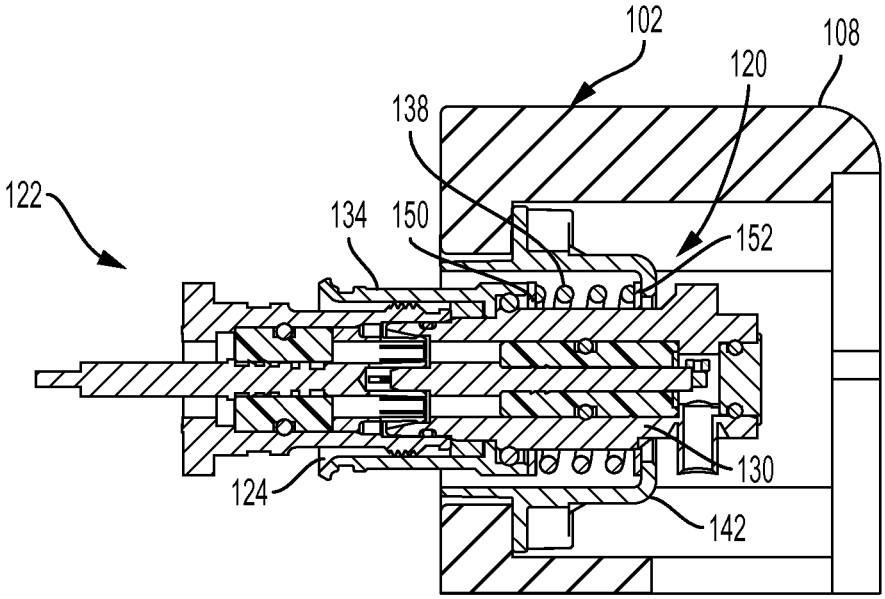
FIG. 6B is a cross-sectional view of the interconnect illustrated in FIG. 6A, showing the mating connectors mated at maximum axial float.
Figure 6C:
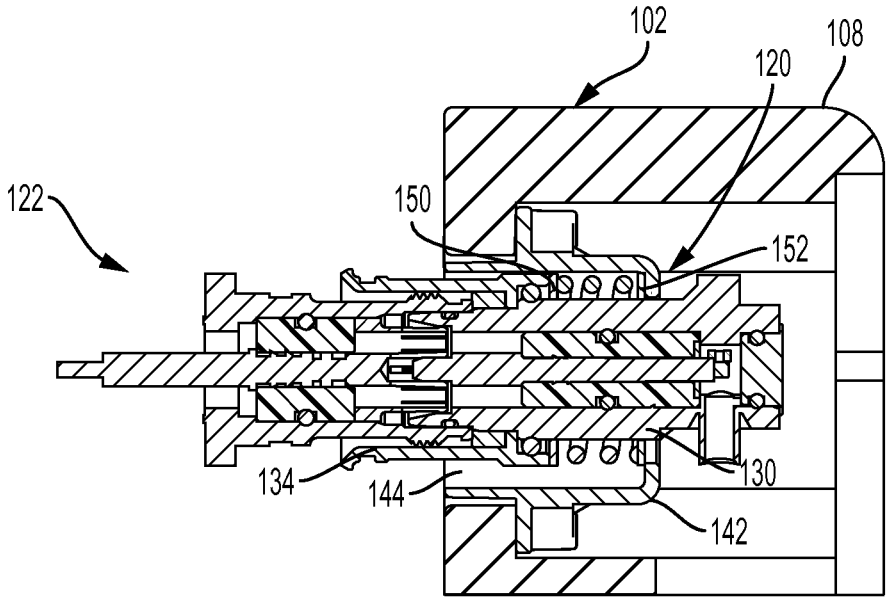
FIG. 6C is a cross-sectional view of the interconnect illustrated in FIG. 6A, showing the mating connectors mated with maximum radial float.

The plug connector 120 generally includes a housing 130 that supports a contact pin 132, a shroud 134 mounted to the housing 130 and surrounding its mating interface 136, and a spring 138 positioned behind the shroud 134 and around the housing 130. The end 140 opposite the interface 136 of the housing 130 is adapted to terminate the cable C (FIG. 2) of the antenna 102. A mounting body 142 of the plug connector 120 mounts the connector 120 in the antenna 102. The mounting body 142 provides space 144 around the housing 130 and the shroud 134 to allow for radial float, as best shown in FIG. 6C. The shroud 134 and housing 130 move within the mounting body 142 to provide the mechanical float of the mated system.

The spring 138 is between the mounting body 142 and the housing 130 and shroud 134 sub-assembly. The spring 138 assists with the axial float of the interconnect 110 when the connectors 120 and 122 are mated, as seen in FIG. 6B. The spring 138 is preferably pre-loaded in the fully assembled state to ensure that the plug connector is always biased outward away from the mounting body 142 and toward the mating connector 122. The spring force should be sufficient to overcome the mating force of the interface between the connectors 120 and 122 to a fully mated condition prior to compressing further. The force should also be sufficient enough to create a significant mating force in all mated positions. This mating force ensures robust RF performance including low PIM even in harsh environments including high shock and vibration. The spring 138 is supported by washers 150 and 152 on both ends thereof to provide a smooth resting surface that will not lock or bind. The washers 150 and 152 also protect the shroud 134 and mounting body 142 from wear, particularly if those components are formed of plastic.

Figure 5:
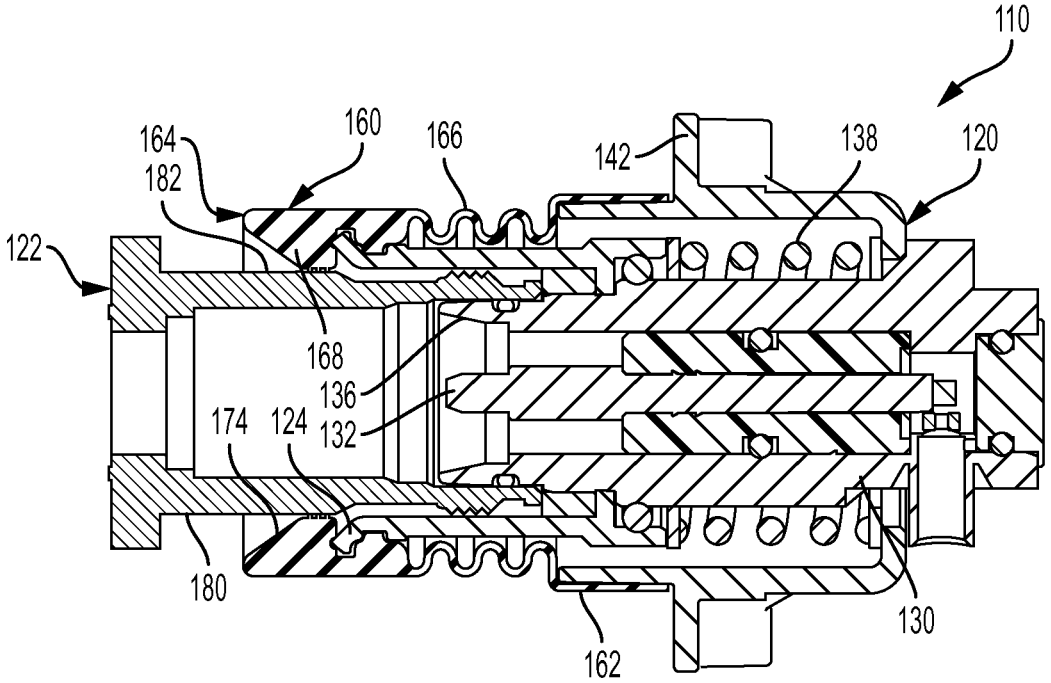
FIG. 5 is a cross-sectional view similar to FIG. 4 showing a mating connector coupled to the connector.

The interconnect 110 may include an optional sealing component, such as a bellows 160 that seals the interconnect 110 from water, ice, debris, and the like. The bellows 160 also seals the electronic system it is mounted to by preventing water or debris from entering the spring cavity where it could collect or pass through the assembly into the dock assembly. The bellows 160 mounts to the shroud 134 and the mounting body 142. The bellows 160 generally includes opposite first and second ends 162 and 164 and a bellows section 166 therebetween. The first end 162 is sized to sealing engage a flange end 146 of the mounting body 142. The second end 164 defines a nose of the bellows 160 that covers the lead-in geometry 124 of the shroud 134. The nose end 164 defines a secondary sealing feature that may be an inwardly extending annular collar member 168 configured to sealing engage the outer surface 182 of the housing 180 of the mating jack connector 122, as best seen in FIG. 5. The collar member 168 preferably includes ribs 170 located on the inner most surface of the collar member 168 to assist in gripping and sealing the outer surface 182 of the jack connector's housing 180. The collar member 168 may also include a sloped lead-in surface 174 to assist and guide the mating of the jack connector 122 with the plug connector 120. O-ring gaskets may also be provided throughout the interconnect 110 to prevent water ingress from all possible paths including the mating interface.

Another advantage of the present invention is that the interconnect 110 is configured to allow the largest number of components thereof to be dielectric instead of metal, such as a thermoplastic mounting body 142 and shroud 134, as such parts have no electrical function. The interconnect 110 also provides generous lead-in, via lead-in geometry 124 and lead-in surface 174, for example, and gathering function for effective blind mating of the antenna 102 and radio unit 104, as best seen in FIGS. 5 and 6A-6C. This blind mate system provides a high degree of mechanical float to compensate for tolerances and misalignment between the two electronic systems. A high degree is +/−3 mm in all axis, for example. The spring 138 may be provided in the interconnect 110 to provide a biasing force that is optimized to overcome the mating force of the interface between the connectors 120 and 122, thereby providing a high mating force to overcome vibration and shock, for example. The shroud 134 helps to guide the mating interfaces of the connectors 120 and 122 together. The shroud 134 may be a separate component which is permanently assembled to the housing 130 or it can be made integral with the housing 130. The shroud 134 is preferably formed of a non-conductive material.

While particular embodiments have been chosen to illustrate the invention, it will be understood by those skilled in the art that various changes and modifications can be made therein without departing from the scope of the invention as defined in the appended claims.

What is claimed is:

1. An antenna unit, comprising:

an antenna;

at least one radio unit; and at least one interconnect including first and second mating connectors, said first connector being configured to be electrically and mechanically coupled to said antenna and said second connector being configured to be electrically and mechanically coupled to said at least one radio unit, wherein said first connector having lead-in geometry, and radial and axial float for blind mating of said first and second mating connectors, wherein said first connector has a spring positioned to facilitate the axial float, and a housing, a mounting body, a housing, a mounting body, and a shroud of said first connector are each formed of a dielectric material, and wherein a docking station extends from said antenna in a plane substantially perpendicular to said antenna.

2. An antenna unit according to claim 1, wherein said interconnect defines a mating direction that is substantially parallel to a longitudinal axis of said antenna.

3. An antenna unit according to claim 1, wherein said interconnect defines a mating direction that is substantially perpendicular to a longitudinal axis of said antenna.

4. An antenna unit according to claim 1, wherein said antenna includes the docking station, said first connector is mounted in said docking station.

5. An antenna unit according to claim 1, further comprising a bellows seal surrounding an interface end of said first connector.

6. An antenna unit according to claim 5, wherein said bellows seal includes opposite first and second ends and a bellows section therebetween, said first end sealingly engages a mounting body of said first connector.

7. An antenna unit according to claim 6, wherein said second end of said bellows seal includes a secondary sealing feature which sealingly engages said second connector.

8. An antenna unit according to claim 7, wherein said secondary sealing feature is an inwardly extending annular collar member which engages an outer surface of said second connector.

9. An antenna unit according to claim 8, wherein said annular collar member includes a sloped lead-in surface.

10. An antenna unit according to claim 1, wherein said lead-in geometry of said first connector is located at an end of the shroud of said first connector.

11. An antenna unit according to claim 1, wherein said housing and said mounting body having a space therebetween configured to provide said radial float.

12. An antenna unit according to claim 11, wherein said spring is disposed around said housing and between first and second washers.

13. An antenna unit, comprising:

an antenna;

at least one radio unit; and at least one interconnect including first and second mating connectors, said first connector being configured to be electrically and mechanically coupled to said antenna and said second connector being configured to be electrically and mechanically coupled to said at least one radio unit, wherein said first connector having lead-in geometry, and radial and axial float for blind mating of said first and second mating connectors, and wherein said antenna includes at least one docking station, and said first connector is mounted in said at least one docking station, and said docking station extends from said antenna in a plane substantially perpendicular to said antenna.

14. An antenna unit, comprising:

an antenna;

at least one radio unit; and at least one interconnect including first and second mating connectors, said first connector being configured to be electrically and mechanically coupled to said antenna and said second connector being configured to be electrically and mechanically coupled to said at least one radio unit, wherein said first connector has a housing, a mounting body, a shroud, and lead-in geometry located at an end of said shroud, and radial and axial float for blind mating of said first and second mating connectors, wherein said housing, said mounting body, and said shroud are each formed of a dielectric material, and wherein a docking station extends from said antenna in a plane substantially perpendicular to said antenna.

* * * * *